US006991068B2

(12) United States Patent
Siikonen et al.

(10) Patent No.: US 6,991,068 B2
(45) Date of Patent: Jan. 31, 2006

(54) METHOD FOR CONTROLLING THE ELEVATORS IN AN ELEVATOR BANK IN A BUILDING DIVIDED INTO ZONES

(75) Inventors: Marja-Liisa Siikonen, Helsinki (FI); Johannes De Jong, Järvenpää (FI); Kimmo Selin, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/990,454

(22) Filed: Nov. 18, 2004

(65) Prior Publication Data

US 2005/0109562 A1 May 26, 2005

Related U.S. Application Data

(63) Continuation of application No. PCT/FI03/00416, filed on May 28, 2003.

(30) Foreign Application Priority Data

Jun. 3, 2002 (FI) ..... 20021057

(51) Int. Cl.
*B66B 1/20* (2006.01)

(52) U.S. Cl. ..... 187/383; 187/388; 187/247

(58) Field of Classification Search ..... 187/247, 187/248, 280–289, 380–389
See application file for complete search history.

(56) References Cited

U.S. PATENT DOCUMENTS 3,831,715 A * 8/1974 Matsuzawa et al. ..... 187/383
4,895,223 A * 1/1990 Ekholm et al. ..... 187/383
5,183,981 A * 2/1993 Thangavelu ..... 187/383
5,317,114 A * 5/1994 Pullela et al. ..... 187/383
5,382,761 A * 1/1995 Amano ..... 187/383
5,480,006 A * 1/1996 Kameli et al. ..... 187/383
5,511,634 A * 4/1996 Bahjat et al. ..... 187/383
5,831,226 A * 11/1998 Hattori et al. ..... 187/382
5,883,343 A * 3/1999 MacDonald et al. ..... 187/383
6,601,678 B2 * 8/2003 Kostka et al. ..... 187/383
6,615,175 B1 * 9/2003 Gazdzinski ..... 704/275
2002/0129994 A1 9/2002 Kostka et al.

FOREIGN PATENT DOCUMENTS

GB 2311 148 A 9/1997
JP 5-155542 A 6/1993
JP 11-255439 A 9/1999

* cited by examiner

*Primary Examiner*—Jonathan Salata
(74) *Attorney, Agent, or Firm*—Birch, Stewart, Kolasch & Birch, LLP

(57) ABSTRACT

Method for controlling the elevators in an elevator bank in a building divided into zones has a plurality of floors via a process whereby destination floor calls are issued to the elevators by destination floor call input devices in the lobby of departure and the calls are distributed internally among different zones in the building by the elevator group control system, the elevators and the floors to be served being divided dynamically within the aforesaid elevator group control system into aforesaid zones, varying the numbers of elevators and the zone limits (r) according to traffic forecasts and transportation need.

11 Claims, 7 Drawing Sheets

Increased waiting time

- Increased up-peak handling capacity
- Increased distance between service zones and increased waiting time

METHOD FOR CONTROLLING THE ELEVATORS IN AN ELEVATOR BANK IN A BUILDING DIVIDED INTO ZONES

FIELD OF THE INVENTION

The present invention relates to a method for controlling the elevators in an elevator bank.

DESCRIPTION OF THE RELATED ART

Prior art is described in patent application U.S. Pat. No. 5,183,981 (B66B 1/20), which discloses a system for channeling an elevator group in up-peak conditions by optimizing the service to floors having a high traffic intensity, by grouping the various floors of the building into sectors. In the arrangement described in the specification, a given elevator car in the elevator group is assigned to serve a sector comprising certain floors in the building. In this arrangement, the number of passengers arriving at floors above each entrance lobby floor is known.

In elevator technology, the above-described division of a building into service sectors is called zoning. Likewise, destination calls are generally known in elevator technology as target floor calls, which means that a passenger wanting to enter an elevator gives his/her target floor already in the lobby of departure when issuing a call for an elevator.

In addition, the above-described prior-art conventional zoning is based on the use of ordinary call buttons. The zone to be served by the elevators has to be shown on displays placed above the door openings of the elevators in the elevator bank, for example so that the information on the display above a given elevator says e.g. that the elevator in question serves floors 12–16, which are regarded as a service zone currently permanently allocated to certain elevators in the elevator group. Because the same elevator in this case may shortly be reallocated to serve a different zone, the information displayed often changes in the lobby of departure.

A problem encountered in prior-art implementations is the fact that the information shown on the displays above the elevators changes very often, which, in the case of large elevator banks, makes it difficult or even impossible to follow this information displayed, with the result that a passenger intending to use an elevator will not necessarily be able to catch or find the right elevator and his/her elevator journey is retarded and delayed substantially.

The principal problem in prior-art solutions is that the number of destination floor calls given by passengers without zoning is large, which increases the traveling time and reduces the transportation capacity of the elevators.

BRIEF SUMMARY OF THE INVENTION

The object of the invention is to reduce the number of elevator-specific destination calls and stoppages and to eliminate the drawbacks encountered in the above-mentioned prior art.

By applying the method of the invention, significant advantages as compared with prior art are achieved.

According to the method of the invention for controlling the elevators in an elevator bank, passengers using the elevators do not know at all that zoning is implemented in the building, because the passengers are told immediately which elevator is going to serve them. In addition, a significant advantage as compared with the existing and known prior art is that no expensive separate elevator-specific displays showing information about service sectors comprising different floors in the building are needed in the elevator lobby, such displays being additionally difficult for the passengers using the elevators to follow.

A further advantage achieved by the present invention is that it also enables the use of extra large elevator groups. The invention makes it possible to use an elevator group comprising 12–16 or more elevators. The elevators may also be located in different lobbies.

An important advantage achieved by the present invention is that the zone limits for the elevators in an elevator group are dynamically changed according to the prevailing transportation need. Therefore, the invention provides the advantage that zoning expressly increases the transportation capacity "in a situation of heavy incoming traffic".

Another significant advantage achieved by the present invention in conventional zoning of the elevators in an elevator pixel group in a building is that it makes it possible to know at an early stage the destinations of the passengers entering the elevator from each floor. Therefore, no elevators need to be allocated to floors or zones void of passengers from where no destination floor calls have been issued. Thus, the transportation capacity of the elevator group can be more efficiently allocated according to the actual transportation need currently prevailing on different floors of the building to zones where a peak traffic situation prevails and/or destination floor calls have been issued.

Furthermore, the present invention can be advantageously used to increase the transportation capacity of the elevators while significantly reducing the traveling times of passengers using the elevators as compared with conventional zoning or a mere elevator group using destination calls. On the other hand, passenger waiting times become longer in the case of an embodiment of the present invention.

The present invention concerns a method for controlling the elevators in an elevator bank in a building divided into zones comprising a plurality of floors via a process whereby destination floor calls are issued to the elevators by means of destination floor call input devices in the lobby of departure and the calls are distributed internally among different zones in the building by the elevator group control system. According to the most advantageous embodiment of the present invention, the elevators and the floors to be served are divided dynamically within the aforesaid elevator group control system into aforesaid zones, varying the numbers of elevators and the zone limits according to traffic forecasts and the need for transportation.

According to a second embodiment according to the invention, in the aforesaid elevator group control system, the zone limits of the zones are divided dynamically into standard floors according to the prevailing traffic. Thus, the zone limits of the zones comprising elevators of the elevator group are unchanged regardless of the transportation need. The maximum number of zones is equal to the number of elevators in the group.

According to a further embodiment, in the aforesaid elevator group control system, elevators are allocated dynamically between different zones.

According to a further embodiment, an elevator arriving at a lobby serves the zone that has remained longest without service and/or where the number of passengers waiting in the zone is largest. Information regarding the number of passengers waiting in each zone is obtained from destination control.

In addition, according to the present invention, one or more elevators in the aforesaid elevator group are preferably used to serve two or more zones in the aforesaid building according to the transportation need.

Further according to the invention, one or more elevators in the aforesaid elevator group allocated to a zone other than the zone comprising the entrance lobby floor are used to serve the entrance lobby floor in addition to their own zone according to the transportation need and traffic forecasts.

In addition, according to a further embodiment of the invention, one or more elevators in the aforesaid elevator group allocated to a zone other than the zone comprising a sky lobby floor are used to serve the sky lobby floor in addition to their own zone according to the transportation need and traffic forecasts.

Further according to an embodiment, in the aforesaid elevator group, using a destination floor call input device, the group elevator control system provides immediate information as to which one of the elevators in the elevator group has been allocated to the passenger.

Further according to an embodiment, the elevators in the aforesaid elevator group are allocated to different zones in such manner that the number of elevators in said elevator group that are allocated to each zone varies according to the transportation need in each zone.

In addition, according to an embodiment of the invention, the number of zone limits varies dynamically according to the transportation need and the transportation capacity of the aforesaid elevator group.

Further according to an embodiment, in the elevator group control system, dynamic zoning is activated when the volume of traffic within the elevator group exceeds a given limit value indicating a peak traffic situation.

In addition, according to an embodiment of the invention, a given zone is only served by elevators in the elevator group that have been actually allocated to the one zone in question or to several other zones.

In addition, according to an embodiment of the invention, it is possible that different elevators in the elevator group have been allocated to either one or two or more zones or to all zones in the building. Likewise, according to the invention, an embodiment is possible in which one or more of the elevators in the elevator group can be allocated to serve all zones.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail by referring to the attached drawings, which are given by way of illustration only, and thus are not limitative of the present invention, and wherein.

DETAILED DESCRIPTION OF THE INVENTION

Figure 1:
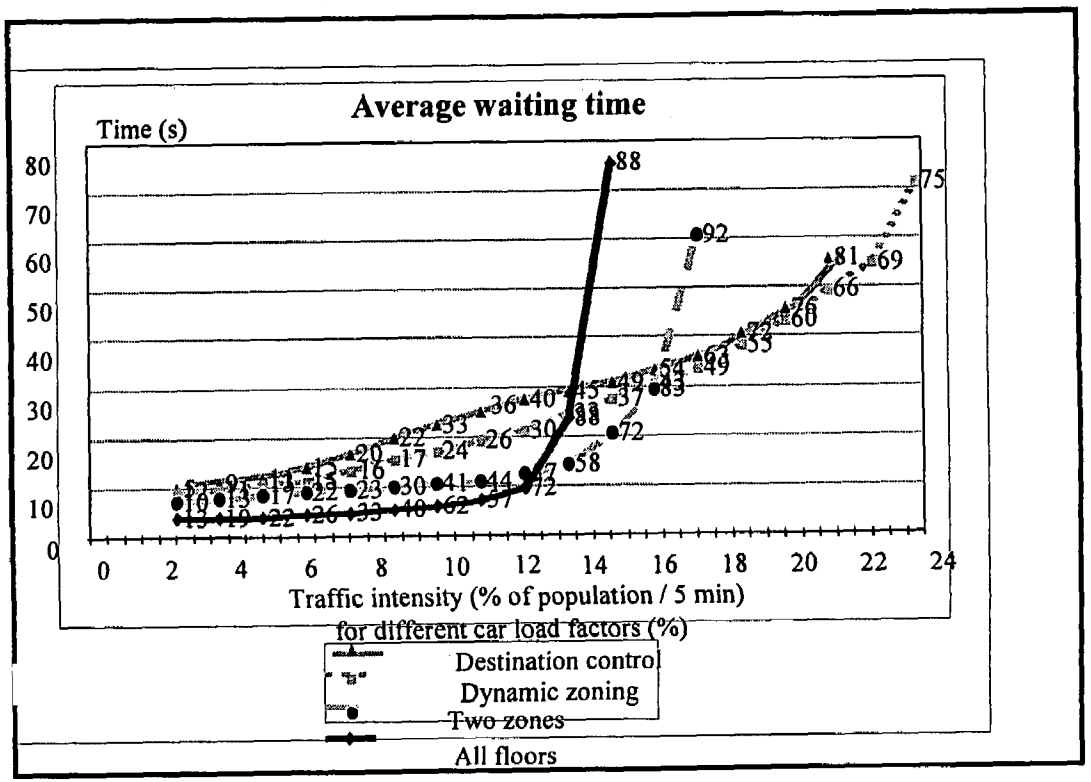
FIG. 1 presents a comparison of the effects of different zoning methods on passenger waiting times and transportation capacity in an elevator group.

FIG. 1 presents a comparison of the effects of different zoning methods on passenger waiting times and transportation capacity in an elevator group when elevator group control methods applying techniques of different types are used. In this figure, the group control methods considered are elevator group control based on normal destination floor call input, dual-zone elevator group control and elevator group control based on dynamic zoning, which is applied in the present invention. The aforesaid figure describes the average waiting time as a function of traffic intensity in the elevator group in the case of the aforesaid three group control methods for controlling the elevators in an elevator bank. The number shown beside the curve is a percentage representing the degree of fullness of the elevator.

From FIG. 1 it can be seen that when dynamic zoning is used as the elevator group control method, an advantage is achieved when the traffic intensity in the elevator group becomes sufficiently high as compared with e.g. an elevator group control method based on normal destination floor call input. On the other hand, when a dual-zone elevator group control method is used, the average waiting time increases when the traffic intensity reaches the limit of transportation capacity of the control method and the degree of fullness of the car exceeds 80 percent. The capacity limit is reached at a significantly earlier stage than in the elevator group control methods based on normal destination floor call input or dynamic zoning.

Figure 2A:
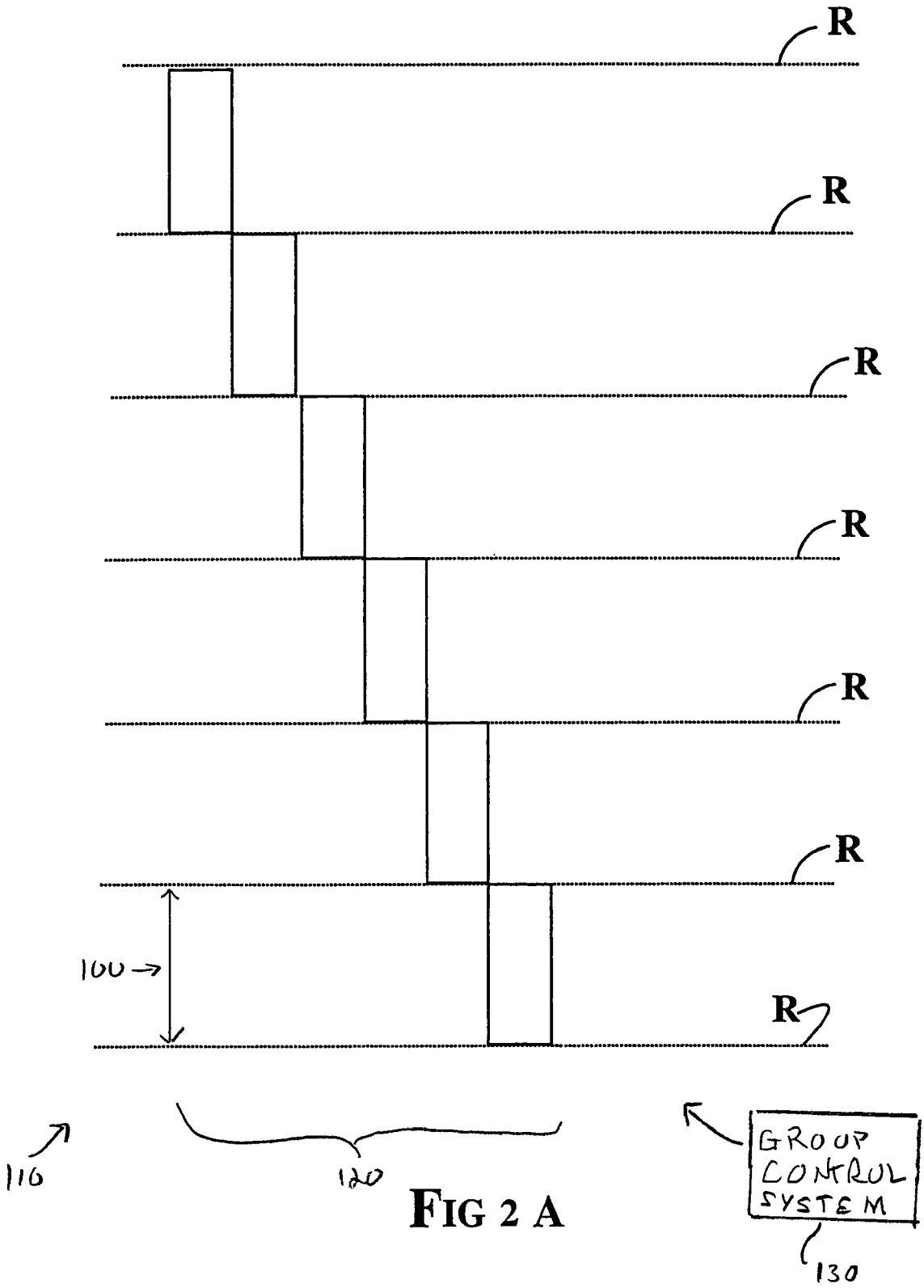
FIG. 2*a* illustrates dynamic zoning according to the invention, which is implemented in the group control of the elevator group when different floors in the building are divided into zones. In the situation presented in this figure, the elevators in the elevator group have been divided into a maximum number of zones. The transportation capacity of the elevator group is now at a maximum, assuming that there is traffic to all zones.

FIG. 2*a* illustrates dynamic zoning according to the invention, which is implemented in the group control system 130 of the elevator group when different floors in the building are divided into zones. Between the zone boundaries R, a series of floors 100 for a building 110 are provided for a bank of elevators 120. While only one series of floors are indicated by reference numeral shown, between two boundaries R in FIG. 2*a*, it should be clear that between each boundary R, any number of floors can be provided. Also, while the embodiment of FIG. 2*a* indicates the group control system 130, the floors 100 and elevator bank 120, these are a part of the other embodiment shown in FIGS. 2*b*–2*f* as well. In the situation presented in this figure, the elevators in the elevator group have been divided into a maximum number of zones. The transportation capacity of the elevator group is now at a maximum, assuming that there is traffic to all zones.

Figure 2B:
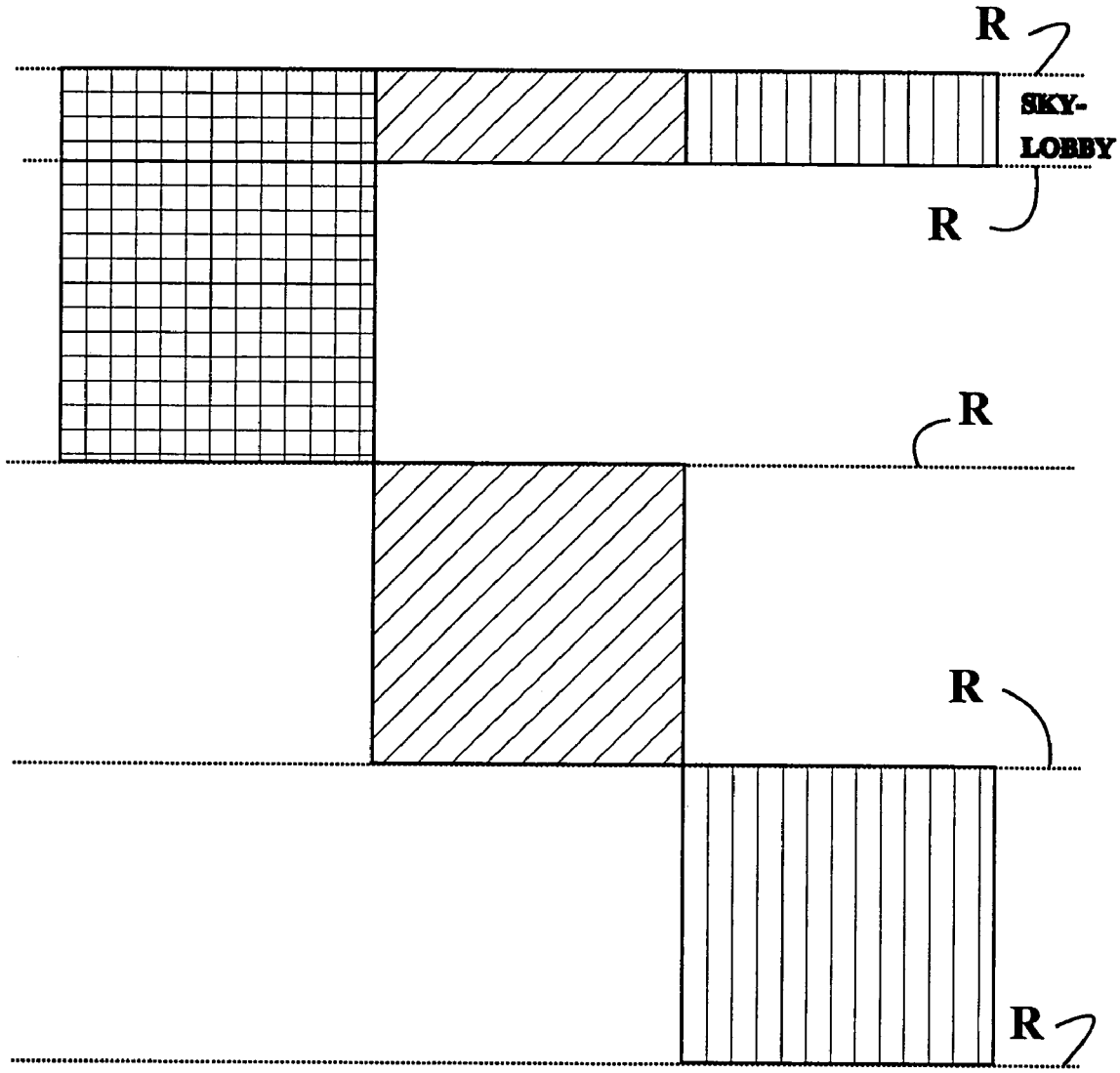
FIG. 2*b* presents an embodiment of the invention for serving the entrance lobby floor when the zone is served by more than one elevators

FIG. 2*b* presents an embodiment of the invention in which one or more elevators of the aforesaid elevator group that have been allocated to a zone other than the zone comprising the entrance lobby floor are used to serve the entrance lobby floor in addition to their own zone. The transportation capacity is now somewhat lower than in the case of FIG. 2*a*, but the waiting times are shorter e.g. in the mornings when people are arriving at their jobs or in the evenings when people are leaving work.

Figure 2C:
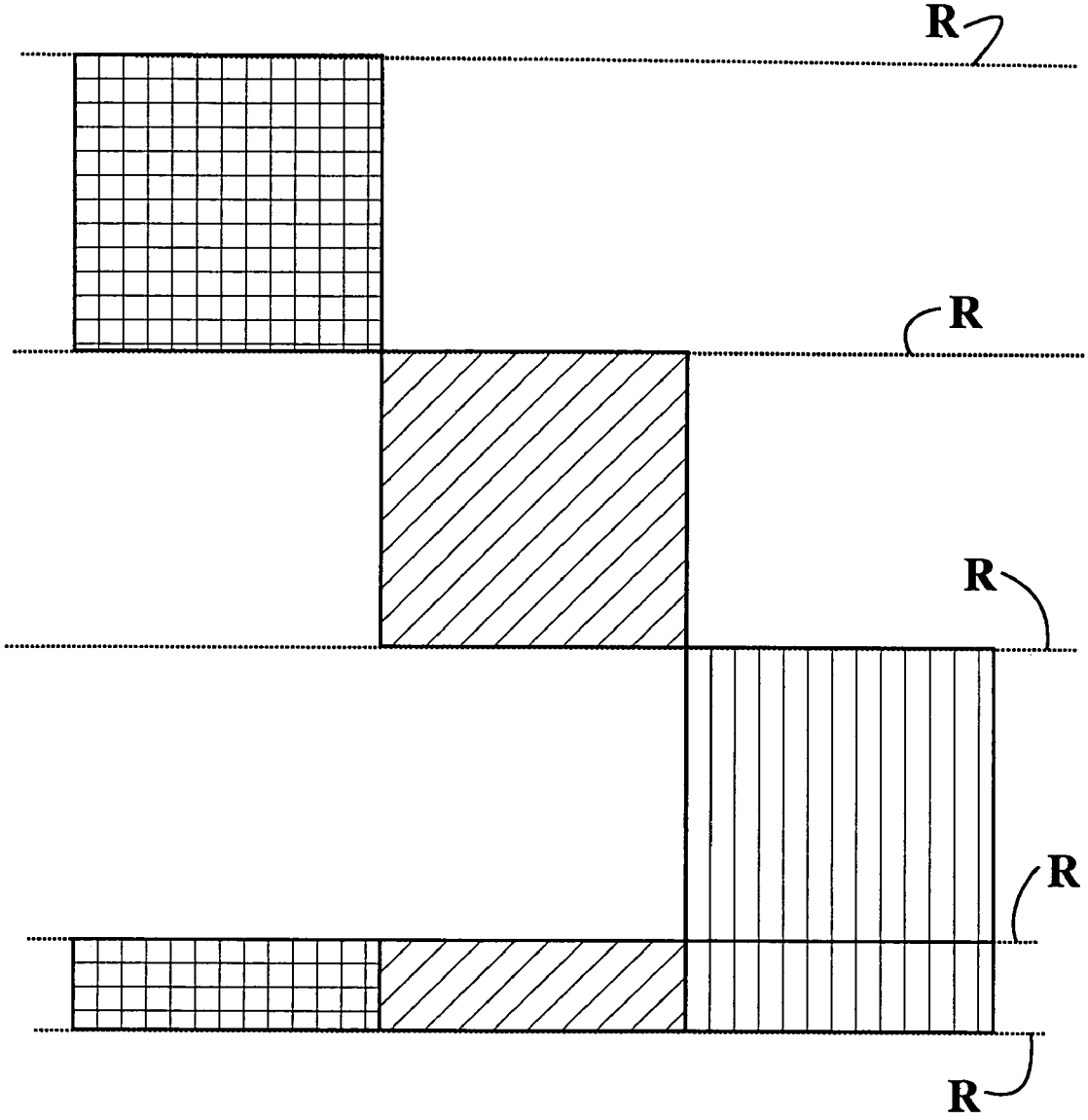
FIG. 2*c* presents an embodiment of the invention for serving a sky lobby floor when the zone is served by more than one elevators, FIG. 2*d* visualizes an embodiment of the invention in which all the elevators in two or more zones in the elevator group serve exclusively a given congested zone.

FIG. 2*c* presents an embodiment of the invention in which one or more elevators in the aforesaid elevator group allocated to a zone other than the zone comprising a sky lobby floor are used to serve the sky lobby floor in addition to their own zone according to the transportation need.

Figure 2D:
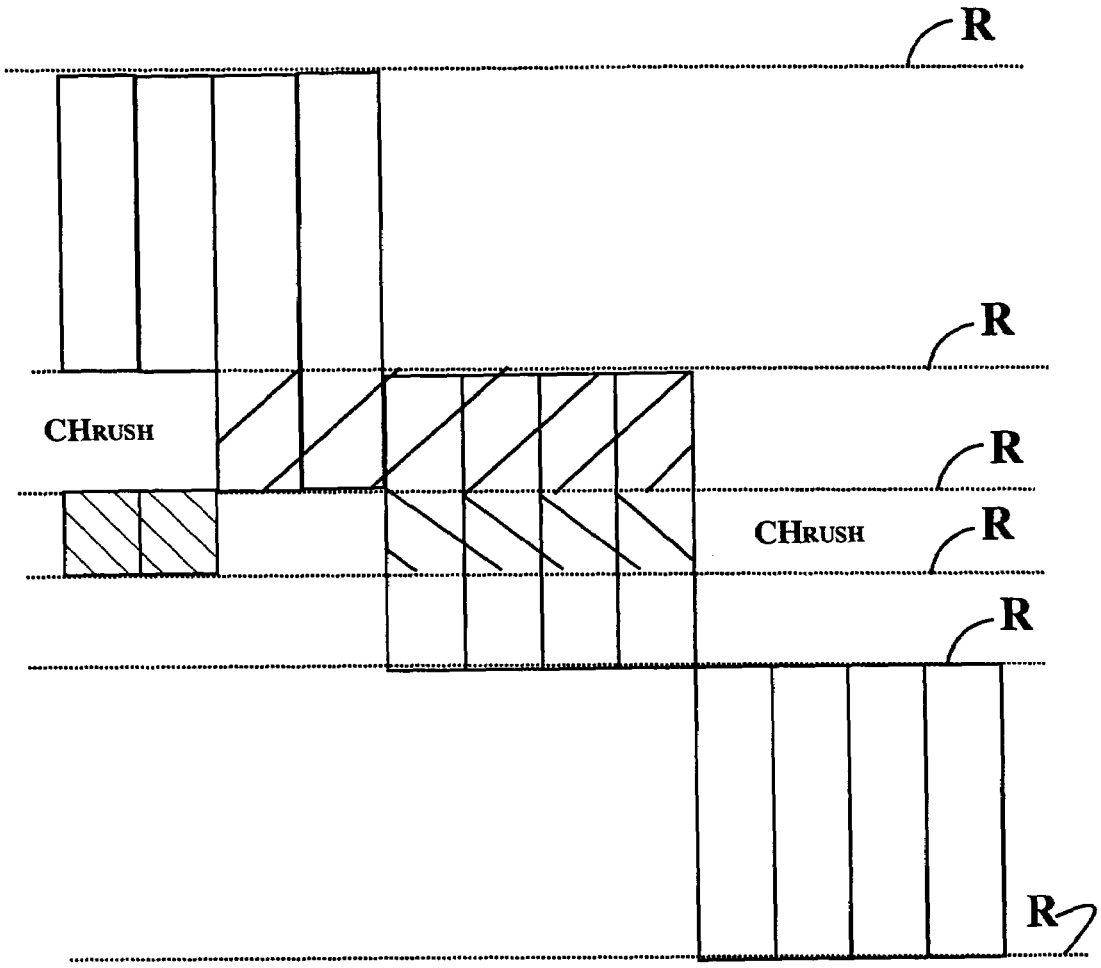
FIG. 2 illustrates the most preferable dynamic zoning under the elevator group control system.
FIG. 2*e* presents an embodiment of the invention in which a zone is served by elevators allocated to one or more other zones.
FIG. 2*f* presents an embodiment of the invention comprising a zone which, in addition to the elevators allocated to this zone, is also served by elevators allocated to other zones.

FIG. 2*d* visualizes an embodiment of the present invention in which all the elevators in two or more zones in the elevator group serve exclusively a given zone of the building where a very high transportation need predicted by traffic forecasts prevails. The elevators are allocated among different zones according to the transportation need so that the largest number of elevators are allocated to serve the most congested zone $CH_{rush}$. It is also possible according to the invention that the zone limit r of the most congested zone $CH_{rush}$ varies dynamically according to the transportation need so that the aforesaid currently most congested zone $CH_{rush}$ comprises a different number of floors in the building in different situations. In addition, the number of zone limits r may vary dynamically according to transportation need so that the number of zones is sometimes increased and sometimes reduced. In addition, according to the present invention, it is possible that the building comprising the elevator group has two or more most congested zones $CH_{rush}$. By applying an overlapping zoning method as illustrated in this figure, it will be possible to manage even heavy peak traffic situations in different zones.

Figure 2E:
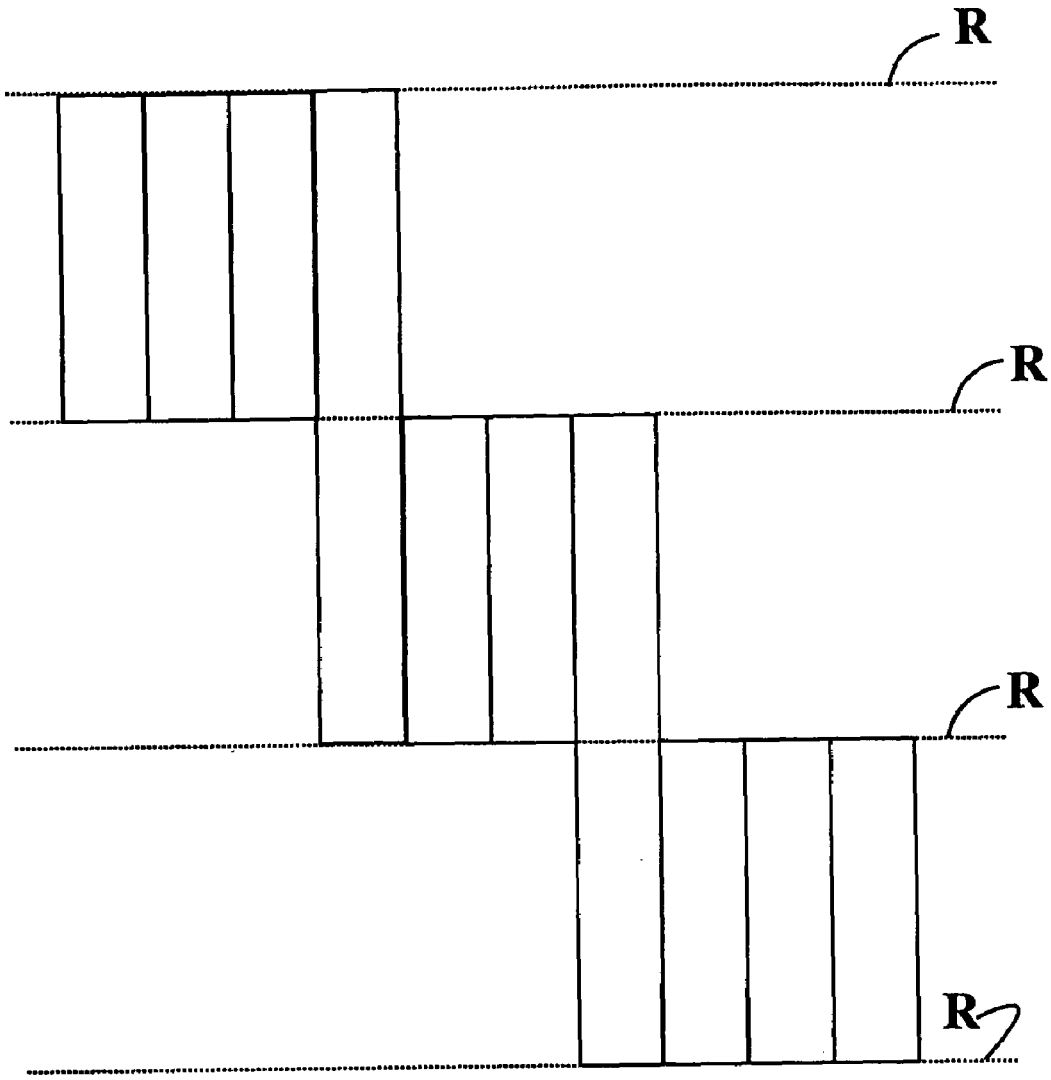

FIG. 2*e* presents an embodiment of the present invention which includes a zone that, in addition to the elevators allocated to that zone, is also served by elevators allocated to other zones. According to this embodiment, this aforesaid zone, which is served by elevators mainly allocated to other zones, is also served by elevators of the elevator group allocated exclusively to this zone. In other words, this zone is served by both elevators of the elevator group that have been exclusively allocated to the zone in question and by elevators actually allocated to other zones according to traffic forecasts and transportation need. This type of zoning can be used e.g. in inter-floor traffic in a single-office building.

Figure 2F:
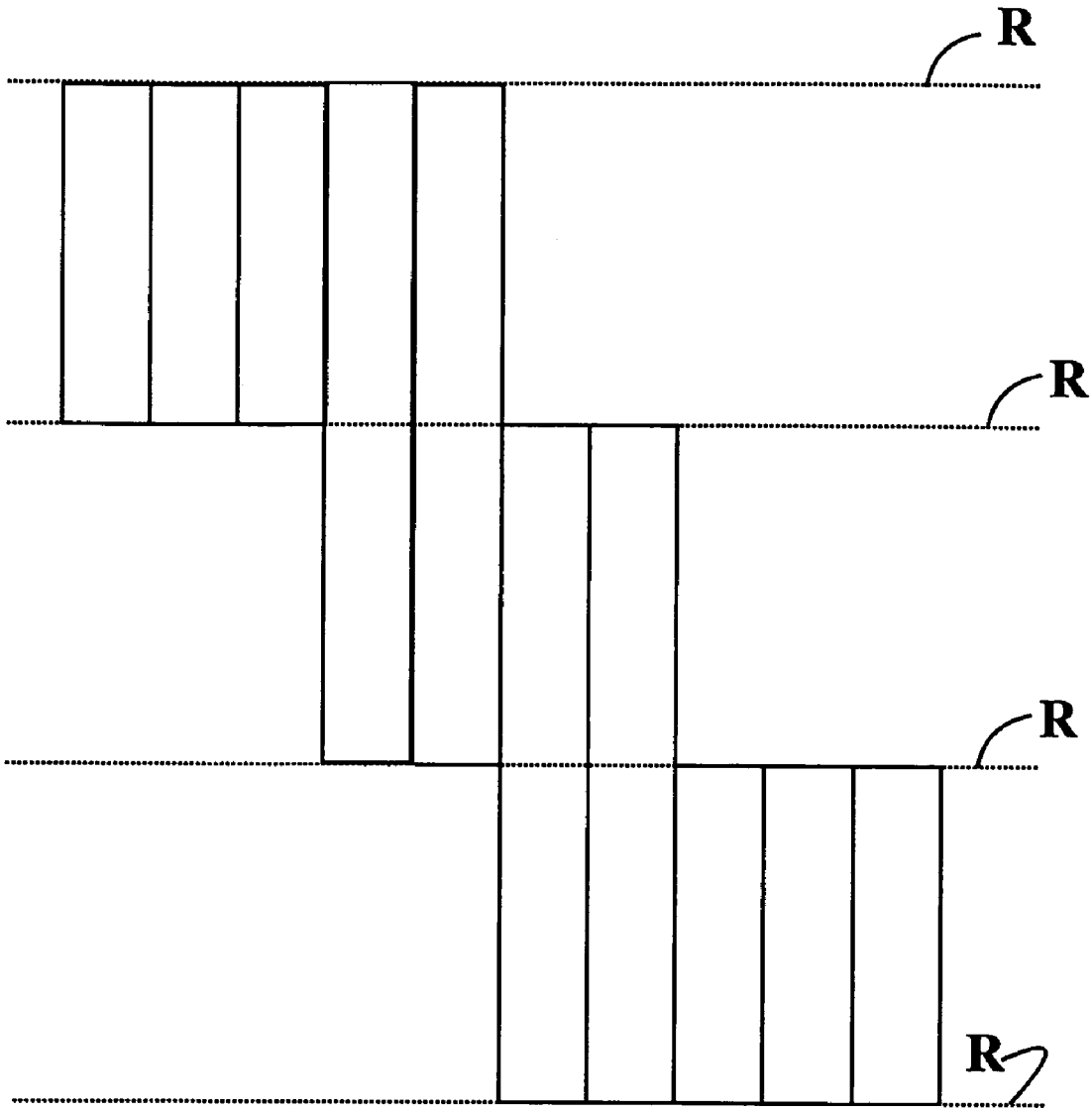

FIG. 2*f* presents an extension of FIG. 2*e*, in which a given zone in a building is served by several elevators in an elevator group which have actually been allocated to one or more other zones in the building. In this case, the current transportation need in the zones determines the zone to which an elevator like this serving two or more zones is allocated in each situation and the number of zones that the elevators are allocated to serve.

In the foregoing, the invention has been described by way of example with reference to the attached drawings while different embodiments of the invention are possible in the scope of the inventive concept defined in the claims.

What is claimed is:

1. A method for controlling the elevators in an elevator bank in a building divided into zones comprising a plurality of floors via a process whereby destination floor calls are issued to the elevators by destination floor call input devices in the lobby of departure and the calls are distributed internally among different zones in the building by the elevator group control system, comprising the steps of:

dynamically dividing the elevators and the floors to be served within the aforesaid elevator group control system into aforesaid zones, instantaneously varying the numbers of elevators and the zone limits according to traffic forecasts and the need for transportation, and in the aforesaid elevator group, using a destination floor call input device, the group elevator control system provides immediate information as to which one of the elevators in the elevator group has been allocated to the passenger.

2. The method according to claim 1, wherein, in the aforesaid elevator group control system, the zone limits (r) of the zones are divided dynamically into standard floors according to the prevailing traffic.

3. The method according to claim 1 or 2, wherein, in the aforesaid elevator group control system, elevators are allocated dynamically between different zones.

4. The method according to claim 1, wherein an elevator arriving at a lobby serves the zone that has remained longest without service and/or where the number of passengers waiting in the zone is largest.

5. The method according to claim 1, wherein one or more elevators in the aforesaid elevator group allocated to a zone other than the zone comprising the entrance lobby floor are used to serve the entrance lobby floor in addition to their own zone according to the transportation need and traffic forecasts.

6. The method according to claim 1, wherein one or more elevators in the aforesaid elevator group allocated to a zone other than the zone comprising a sky lobby floor are used to serve the sky lobby floor in addition to their own zone according to the transportation need and traffic forecasts.

7. The method according to claim 1, wherein one or more elevators in the aforesaid elevator group are used to serve two or more zones in the aforesaid building according to the transportation need.

8. The method according to claim 1, wherein the elevators in the aforesaid elevator group are allocated to different zones in such manner that the number of elevators in said elevator group that are allocated to each zone varies according to the transportation need in each zone.

9. The method according to claim 1, wherein the number of zone limits varies dynamically according to the transportation need and the transportation capacity of the aforesaid elevator group.

10. The method according to claim 1, wherein in the group control system of the aforesaid elevator group, dynamic zoning is activated when the volume of traffic within the elevator group exceeds a given limit value indicating a peak traffic situation.

11. The method according to claim 1, wherein a given zone is only served by elevators in the elevator group that have been allocated to the zone in question or to several other zones.

* * * * *